US005992285A

United States Patent [19]

Talarico

[11] Patent Number: 5,992,285

[45] Date of Patent: Nov. 30, 1999

[54] FLOATING PUNCH HOLDER

[76] Inventor: Joe Talarico, 1241 Beatty Ave., Verdan,Que., Canada, H4H 1Y2

[21] Appl. No.: 08/649,111

[22] Filed: May 14, 1996

Related U.S. Application Data

[63] Continuation-in-part of application No. 08/343,089, Nov. 21, 1994, abandoned.

[51] Int. Cl.[6] ..... B26D 7/00

[52] U.S. Cl. ..... 83/684; 83/698.91; 83/699.31; 83/699.51

[58] Field of Search ..... 83/698.4, 698.91, 83/699.31, 699.51, 685, 684, 686

[56] References Cited

U.S. PATENT DOCUMENTS

| | | | |
|---|---|---|---|
| 770,238 | 9/1904 | Lovejoy | 83/698.91 |
| 2,217,560 | 10/1940 | Michon | 83/698.91 |
| 2,242,363 | 5/1941 | Michon | 83/698.91 |
| 2,974,967 | 3/1961 | Felmet | 83/698.91 |
| 3,086,419 | 4/1963 | Fox | 83/684 |
| 3,109,470 | 11/1963 | Urschel et al. | 83/698.91 |
| 3,111,053 | 11/1963 | Svensson | 83/698.91 |
| 3,296,905 | 1/1967 | Killaly | 83/685 |
| 3,342,091 | 9/1967 | Schott et al. | 83/685 |
| 3,892,158 | 7/1975 | Smeets | 83/699 |
| 4,103,413 | 8/1978 | Malmberg | 83/698 |

FOREIGN PATENT DOCUMENTS

| | | | |
|---|---|---|---|
| 1552056 | 12/1969 | Germany | 83/698 |
| 1171895 | 11/1969 | United Kingdom | 83/698.91 |

*Primary Examiner*—M. Rachuba
*Attorney, Agent, or Firm*—Mila Shvartsman

[57] ABSTRACT

A floating punch holder is attached by a chuck to a punching apparatus. The floating punch holder has a shank with upper and lower portions. The upper portion of the shank is held by the punching apparatus. The lower portion of the shank holds a punch in vertical alignment. The chuck allows for adjusting, aligning and centering the punch while maintaining the vertical alignment of the punch.

15 Claims, 4 Drawing Sheets

FLOATING PUNCH HOLDER

This application is a continuation-in-part of application Ser. No. 08/343,089, filed Jan. 21, 1994, now abandoned.

The present invention relates to an apparatus for affixing a punch onto a machine such as a punch press, more particularly to a floating punch-holder, and provide the means to align the punch within the punch-holder with a corresponding hole in a die set on the bed or horn of the aforesaid machine to avoid the need of using a specialised machine or die set.

There is known U.S. Pat. No. 4,757,609 describing an apparatus for joining sheet materials utilizing a novel die construction showing a punch assembly of a conventional construction including a punch body supporting a stripper retainer. Disposed within the retainer is a stripper biased to the stripping position by means of coil springs.

There are also known machines which are built especially for punching, and provide all the facilities of alignment without complications. However, these machines can only be used for punching.

There are known machines called "C-Frame Holder"; this device is made to receive a punch and die which will be aligned at all times, but these tools are limited to be used only as an edge punch-up to the throat depth of the frame holder.

Also, there is known a floating punch-holder which comprises a two-piece chuck that has a hexagonal-shaped exterior with six crisscrossing Allen screws for alignment. The bottom portion of said chuck is used as a fastener. A "T"-shaped shank having a top portion of a larger diameter and of a circular configuration is placed in said two-piece chuck. In this tool, the adjustments which are made to align the punch with the die will place the round-shaped top or head of the shank off centre when using the adjustment screws, and as a result, cause substantial difficulty in obtaining accurate alignment.

There is also known U.S. Pat. No. 3,296,905 related to a compressive stripping unit and indexing type nibbling punch for turret punch presses; this machine assures proper and complete stripping of blanked material away from the punch and die. It further allows several and differently-shaped punches to operate at different intervals. However, these punches and the complete apparatus has only possible vertical or up-and-down movements, and does not allow centring by means of lateral movements.

It is therefore a primary object of this invention to provide an improved and simplified apparatus which permits easy, quick and accurate alignment of a punch with the corresponding blanking or drawing die.

The apparatus according to the present invention may be garnished with a stripper set on a spring so that the blanked material may be stripped from the punch. The collar may also be used as a pressure pad if the punch is used for drawing metal Another advantage of the present invention is that more than one punch-holder may be used simultaneously without any dimensional restrictions.

These and other objects, features and advantages of the present invention will become apparent from the subsequent description and the appended claims, taken in conjunction with the accompanying drawings.

SUMMARY OF THE INVENTION

The present invention is a floating punch-holder for a punching apparatus consisting of an assembly of a chuck having an upper portion and a lower portion. The upper portion of the chuck is provided to be securely attached to the punching apparatus. The chuck is provided to hold a shank having an upper portion and a lower portion, the upper portion of the shank is held by the chuck and the lower portion of the chuck is connected to a punch adapted to cooperate with a die located below the punch. The lower portion of the chuck is further provided with an open-ended cavity formed within the bottom of the lower portion.

It is therefore an object of the present invention that the upper portion of the shank has a configuration and dimensions allowing adjustment of the shank within the cavity in lateral directions necessary for precise alignment and centering of the punch with the die; the lateral adjustment is provided by movement of inwardly directed first set of screws cooperating with the corresponding sides of the upper portion of the shank facilitating lateral movement of the upper portion of the shank within the cavity.

In one embodiment of the present invention, the locking of the shank portion is provided by a fastener having a thread formed around an outer wall of the fastener. This thread cooperates with a corresponding thread formed within the cavity. There is an obtuse-angled groove formed around the outer wall of the fastener which cooperates with the second set of inwardly-directed screws located within the cavity. The fastener is provided to securely hold the upper portion of the shank within the cavity in an immobile position without disturbing the alignment and centering of the punch with the die.

In another embodiment of the present invention, the upper portion of the shank has a square cross-section with bevelled corners. The sides of upper portion tapered downwardly at a pre-determined angle. Centering of the punch is provided by a set of screws directed inwardly and upwardly within the cavity. This set of screws abuts tapered sides of the upper portion of the shank.

BRIEF DESCRIPTION OF THE DRAWINGS

FIG. 12A shows a side cross-sectional view of the die.

DETAILED DESCRIPTION OF THE PRESENT EMBODIMENTS

Figure 1:
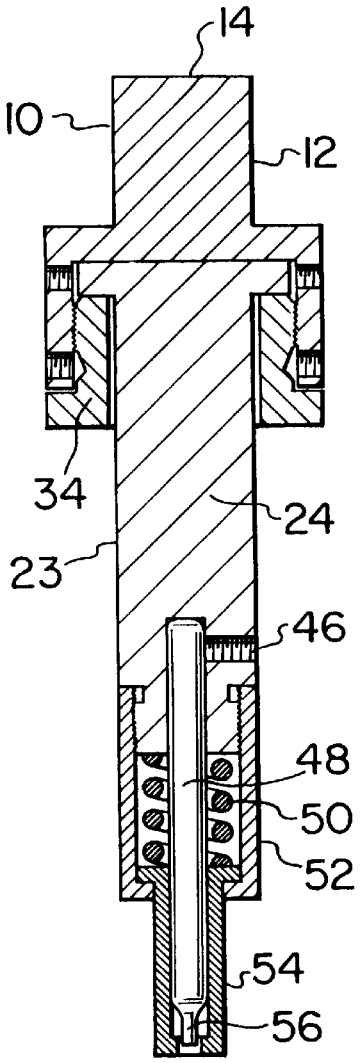
FIG. 1 shows a side cross-section of the floating punch-holder according to the present invention.
Figure 2:
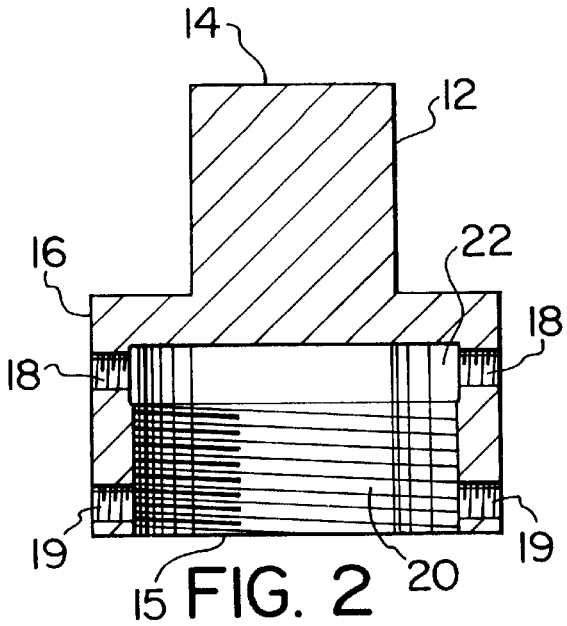
FIG. 2 shows a side cross-section view of the first modification of the chuck means taken along the lines A—A of FIG. 3.
Figure 3:
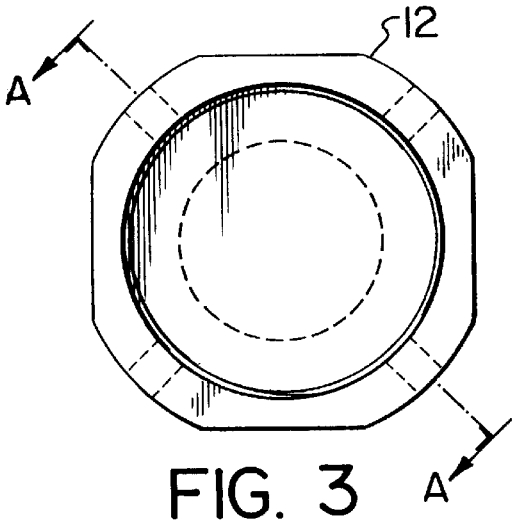
FIG. 3 shows a bottom view of FIG. 2.
Figure 6:
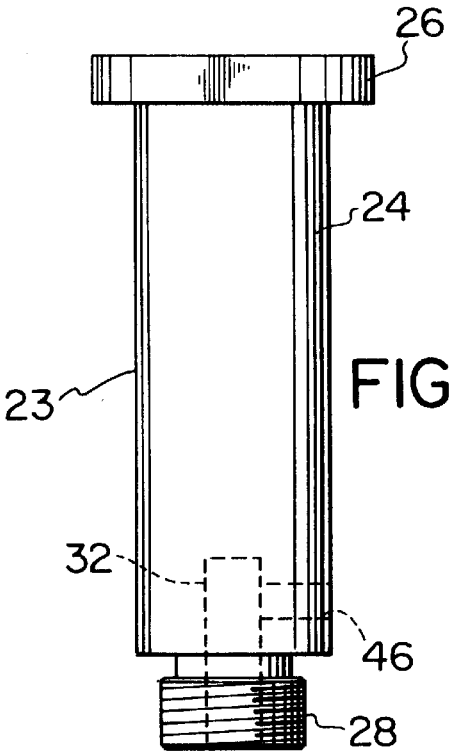
FIG. 6 shows a side view of the shank means according to the present invention.
Figure 7:
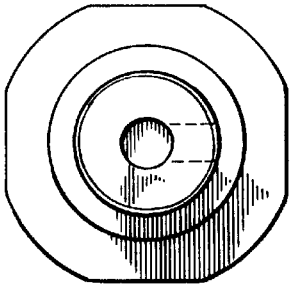
FIG. 7 is a bottom view of FIG. 6.

Referring now to drawings, FIG. 1 shows a floating punch-holder 10 comprising a chuck means 12 of unitary configuration having an upper portion 14 having in the first embodiment a shape of a stub provided for fastening into a ram. The lower portion 16 of the chuck 12 has a cavity 15 consisting of a lower cavity 20 and an upper cavity 22. Preferably, the cavity 15 is of round or cylindrical configuration (see FIG. 2). FIGS. 6 and 7 show a shank means comprising an upper portion or head 26 and a shank 24 adapted to hold a punch 48 inserted into a bore 32 by means of a set screw (not shown) which is inserted into the corresponding opening 46. The head 26 of the shank 24 has a square-shaped configuration with rounded corners, and is of smaller dimension than the dimension of the upper portion 22 of the cavity 15. The shape of the head provides easy and wider adjustment of said shank 23 within the cavity 15, and also allows the shank 23 to be adjustable right-left or front-back during alignment. Said head 26 is aligned within the upper portion 22 of the cavity 15 by alignment means comprising a set of crisscross screws 58 being inserted within the corresponding openings 18 formed in the lower portion 16 of chuck 12.

Figure 4:
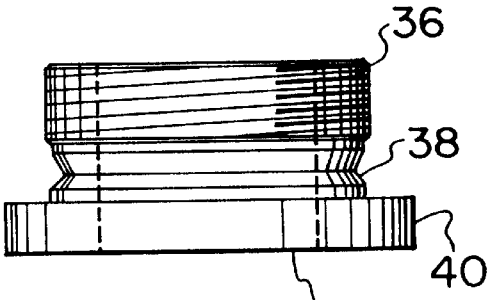
FIG. 4 shows a side view of the fastener means according to the present invention.
Figure 5:
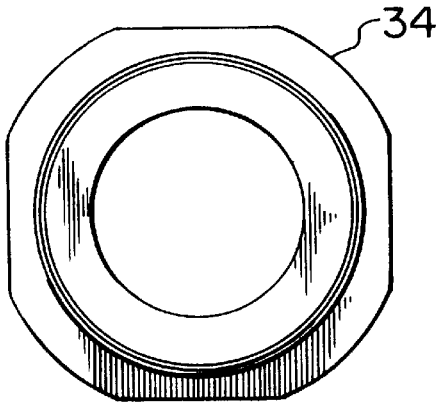
FIG. 5 is a bottom view of FIG. 4.
Figure 8:
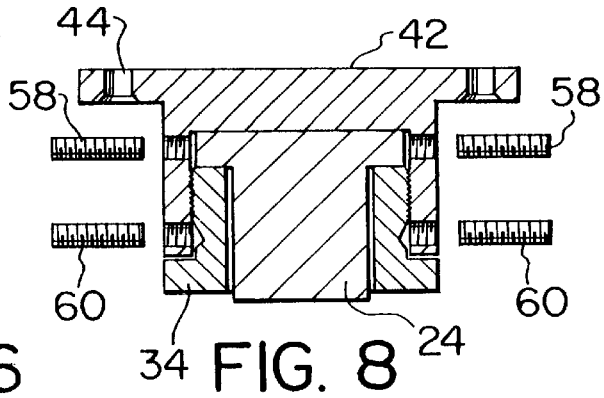
FIG. 8 shows a partial side cross-section of the punch-holder with a chuck means of the second modification.
Figure 9:
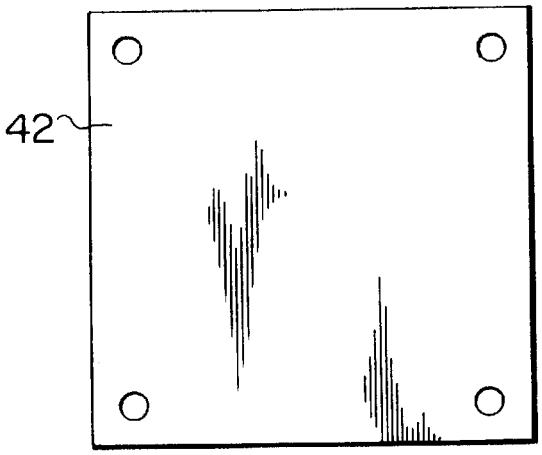
FIG. 9 is a top view of FIG. 8.

The punch-holder according to the present invention further comprises a fastener means or collar 34 (see FIGS. 4 and 5) which is adapted to be fastened into the cavity 15 of the chuck 12 by tightening means or thread portion 36 formed on the outer wall of said fastener 34. The fastener 34 is adapted to securely lock said sank means 23 within said cavity 15. The thread portion 36 in this case is cooperating with the corresponding thread 21 formed around an inner wall of the lower portion 20 of the cavity 15. Below the thread portion 36 and around the outer wall of the fastener 34, a groove 38 with an obtuse angle in cross-section is formed. Preferably, an upper edge of the groove 38 is longer than a lower edge to facilitate successful locking of said fastener 34, wherein the groove is adapted to cooperate with a set of cris-cross screws 60 which are screwed into four corresponding openings 19 located at the lower portion 16 of chuck 12. This combination of groove 38 and set of criss-crossed screws 60 comprises a locking means, wherein said screws are adapted to penetrate into said groove 38 thus forcing said fastener 34 upwardly to lock immobily the shank 24 within the cavity 15. The lower portion 40 of the fastener 34 is easily tightened within the cavity 15 by means of a conventional tool such as wrench. FIGS. 8 and 9 show a second modification of the chuck means having an upper portion made in the shape of plate 42 which is attached to the punch machine by means of screws (not shown) inserted into the corresponding openings 44 on said plate 42. Such an arrangement allows the user to mount or hold a number of punch-holders 10 aligned to each other.

Figure 12:
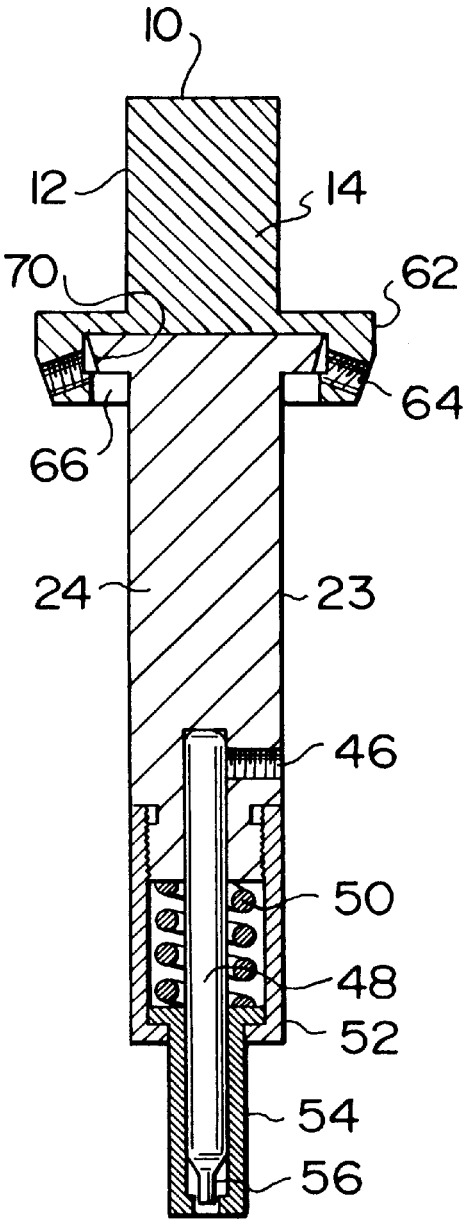
FIG. 12 is a side cross-section of the floating punch-holder showing a second embodiment of the present invention.
Figure 14:
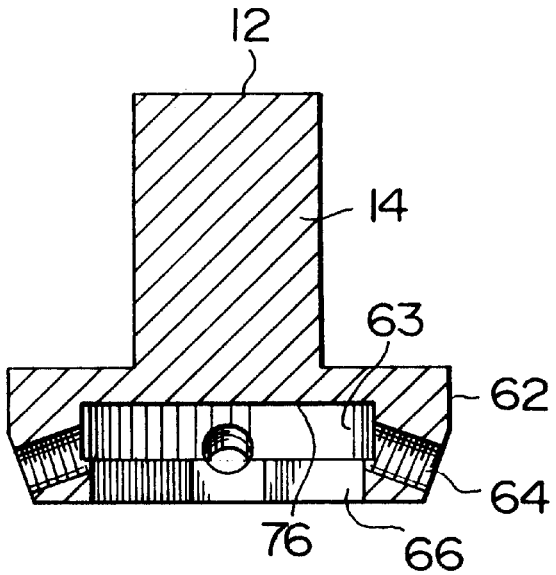
FIG. 14 is a side cross-section view of the chuck means shown on FIG. 12.
Figure 13:
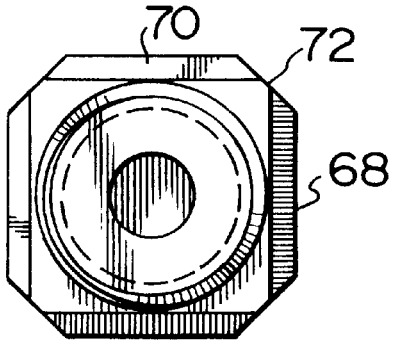
FIG. 13 is a bottom view of shank means shown on FIG. 12.
Figure 15:
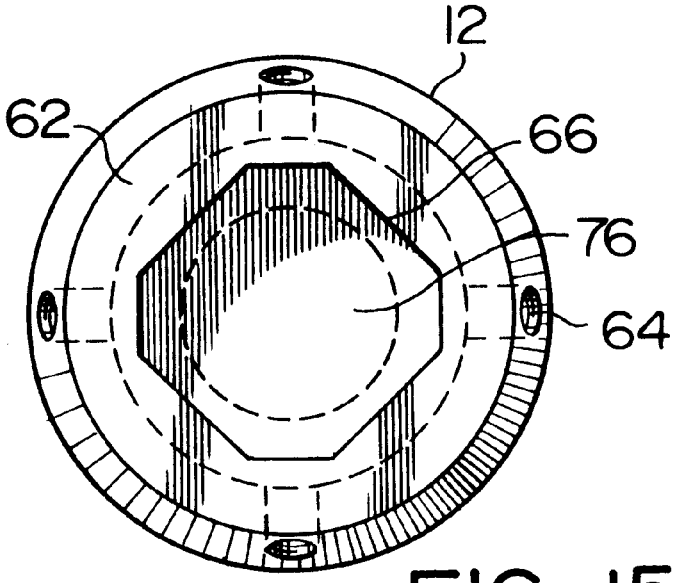
FIG. 15 is a bottom view of chuck means of FIG. 14.
Figure 16:
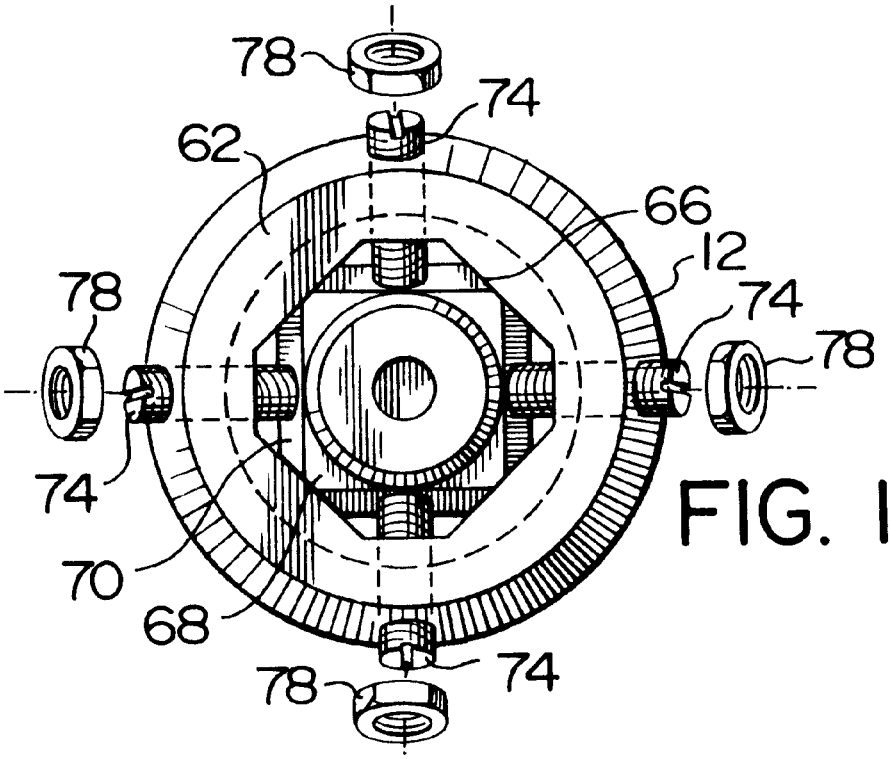
FIG. 16 is a bottom view of the floating punch-holder of FIG. 12.

The lower portion of the shank 24 is provided with a bore 32 for holding punch 48 by means of a set screw (not shown) to be inserted within the corresponding opening 46. The punch-holder further includes a spring holder 52, crown 54 and a spring 50. A tip 56 of the punch 48 is adapted to cooperate with a die 17 shown on FIG. 12A to perform a punching process.

The centring operation of the punch 48 is done by first unscrewing set screws 58 and 60, and then loosening the fastener 34 just until it is not tight. The punch can then be moved to the right by unscrewing the set screws 58 on the right and tightening the set screws 58 on the left. This method or the reverse is used for moving the punch right or left and front or back. Usually, minor adjustments can be made by proceeding with successive steps of one quarter turn for each screw. Fastener 34 and all screws must be tightened when the adjustment is completed. The inspection for concentricity can be made visually. Thinner material, such as 0.012" or 0.3 mm require greater accuracy than thicker material, such as 0.018"+ or 0.45 mm+.

The punch-holder according to the present invention in combination with the conventional punch apparatus is adaptable to be adjusted to perform any punch operation providing forming or deforming materials, such as joining, fastening, blanking, drawing, swaging, stamping and marking.

The unique feature of the punch-holder according to the present invention allows easy fastening of steel thicknesses as light as 0.010" as well as stainless steel with a strong lock. The apparatus of the present invention provides a variety of tooling configurations and thus, to manufacture different-shaped products which may have hard-to-reach comers, narrow flanges, high sides and other elements. It is highly efficient in the air distribution industry for manufacturing of ducts, elbows, and fittings.

The floating punch-holder according to the present invention makes it possible to simultaneously install one or more punches in aligned configuration onto or within the ram of the machine, such as a punch press with a mating die or dies on the bed or horn of said machine, thus eliminating the need of a die set or "C" frame, and be perfectly aligned and centred with said mating die or dies.

Figure 10:
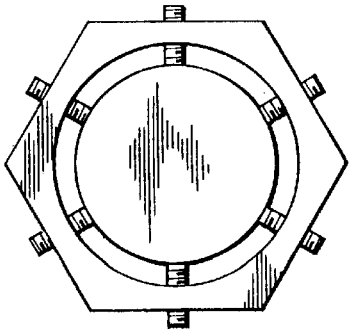
FIG. 10 PRIOR ART
FIG. 10 shows a schematic plan cross-section view of the Prior Art.

FIG. 10 shows a prior art design, wherein the round-shaped head of the shank is mounted within a hexagonal-shaped two-piece chuck in which the lower part is performing the function of a fastener. In this arrangement it is necessary to use six adjustment set screws to make an alignment operation. However, these adjustment screws may cause the head of the shank to be "off" centre, thus resulting in misalignment. To tighten the system, the fastener is turned, which disturbs the adjustment. However when joining light gauge material, the adjustment must be very accurate to prevent damage.

Figure 11:
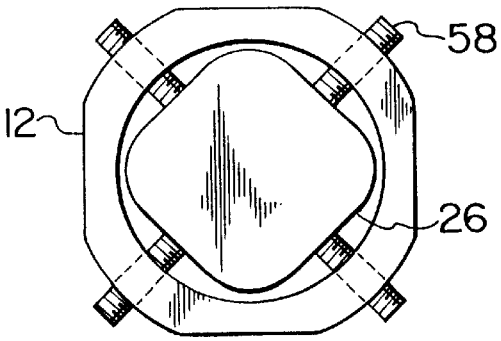
FIG. 11 shows a schematic plan cross-section view of the assembly according to the present invention.

This problem does not exist with the present configuration of the head (see FIG. 11). The improved square-shaped head with round corners leaves the shank immobile as the system is tightened by means of fastener 34 and locked by means of set screws 60.

Referring now to drawings, FIGS. 12–16 show a second embodiment of the floating punch-holder 10 comprising the chuck means 12 of unitary configuration and having the upper portion 14 similar to the one shown on FIG. 1. However, the lower portion 62 is substantially shorter that the one of FIG. 1 in view of the fact that this embodiment of punch-holder eliminates the need of fastener 34 and two set of screws 58 and 60. In this improved embodiment the lower portion 62 of chuck 12 is provided with an open ended cavity formed within said lower portion 62. This cavity consists of an upper cylindrical cavity 63 and a lower cavity or opening 66. There are locking means located within said cavity which comprise a set of cris-cross screws 74 adapted to be screwed into corresponding threaded openings 64 formed within the lower portion 62 of chuck 12. Those openings 64 are directed inwardly upwardly under a predetermined angle. Preferably but not necessarily, this angle is about 20 degrees. The lower cavity or opening 66 has in cross-section a configuration corresponding to the configuration of the upper portion or head 68 of shank 23. As it shown on FIG. 13, the upper portion or head 68 has in cross-section a square-headed with bevelled corners 72 configuration. Sides 70 of said head 68 taper downwardly under a predetermined angle. The configuration of the lower portion of shank 23 and punch assembly is identical to the first embodiment shown on FIG. 1 and will be not discussed in detail. It is also possible to make the upper portion of chuck 12 having configuration shown on FIGS. 8 and 9 made as the plate 42 instead of stub 14.

In operation, the shank 23 is inserted into the upper cavity 63 through the opening 66 and is then turned axially within said cavity 63 at 45°; this is necessary to retain the shank 23 in place before centring of punch-holder is initiated. The centring operation is similar to centring of the punch-holder of the first embodiment. Firstly, all four screws 74 should be loosened. Then, the punch can be centred with the die by means of lateral movement of the upper portion or head 68 within the cavity 63 in right-left and back-front positions, wherein corresponding set of cris-cross screws 74 are tightened. These screws 74 are adapted to cooperate with angled sides 70 of the head 68 not only to adjust and hold the shank 23 in a set position, but also to further lock said shank 23 immobily within the upper cavity 63. This locking operation is provided by means of locking said screws 74 using locknuts 78. As a result, when screws 74 are gradually tightened, the upper portion or head 68 is forced upwardly until it abuts an inside face 76 of the chuck 12 and shank 23 is immobily locked in place.

The advantage of the second embodiment is the fact that this structure eliminates the necessity of using a fastener. Besides, since cavities 63 and 66 are much shorter than in the first modification, this allows fastening of products having higher sides.

The foregoing discloses and describes exemplary embodiments of the present invention. One skilled in the art will readily recognize from such discussion and from the accompanying drawings that various changes, modifications and variations may be made therein without departing from the spirit and scope of the invention as defined in the following claims.

What is claimed is:

1. Floating punch-holder for a punching apparatus comprising an assembly of:

a chuck having an upper portion and a lower portion, the upper portion of said chuck is provided to be securely attached to the punching apparatus, said chuck is provided to hold a shank having an upper portion and a lower portion, the upper portion of said shank being held by said chuck and the lower portion of said shank is connected to a punch, said punch is adapted to cooperate with a die located below the punch and centered with said punch;

wherein the lower portion of said chuck is further provided with an open-ended cavity formed within a bottom of said lower portion and with means for centering and immobily locking the upper portion of said shank, wherein the upper portion of said shank has a configuration and dimensions allowing adjustment of said shank within said cavity in lateral directions necessary for precise alignment and centering of said punch with said die, said lateral adjustment is provided by means of movement of said means for centering and immobily locking cooperating with the corresponding sides of the upper portion of said shank, thus facilitating lateral movement of the upper portion of said shank within said cavity.

2. Floating punch-holder according to claim 1, wherein said upper portion and said lower portion of said chuck has a unitary configuration.

3. Floating punch-holder according to claim 1, wherein said means for centering and immobily locking further comprises:

fastener provided to securely fasten the upper portion of said shank in an immobile position without disturbing the alignment and centering of said punch with said die.

4. Floating punch-holder according claim 3, wherein said cavity has a cylindrical configuration, and wherein said upper portion of said shank has a square cross-section with rounded corners.

5. Floating punch-holder according to claim 4, wherein said means for centering and immobily locking comprises a first set of screws directed inwardly within said cavity.

6. Floating punch holder according to claim 3, wherein said fastener further comprises a tightening means which comprises a thread formed around an outer wall of said fastener, said thread cooperates with a corresponding thread formed within said cavity.

7. Floating punch-holder according to claim 6, wherein said means for centering and immobily locking further comprises an obtuse-angled groove formed around the outer wall of said fastener and a second set of inwardly directed screws located within said cavity, wherein said second set of screws mates with said groove forcing said fastener upwardly in within said cavity.

8. Floating punch-holder according to claim 7, wherein said groove comprises an upper edge and a lower edge, and wherein the upper edge of said groove is longer than the lower edge of said groove.

9. Floating punch-holder according to claim 7, wherein said groove is formed below the thread of said fastener means.

10. Floating punch-holder according to claim 11, wherein the upper portion of said chuck means comprises a plate.

11. Floating punch-holder according to claim 1, wherein said shank has a T-shaped cross-section.

12. Floating punch-holder according to claim 1, wherein the upper portion of said chuck comprises an upwardly extending stub.

13. Floating punch-holder according to claim 1, wherein the upper portion of said shank has a square cross-section with bevelled corners, and wherein sides of said upper portion are tapered downwardly predetermined angle.

14. Floating punch-holder according to claim 13, wherein said means for centering and immobily locking comprises a set of screws directed inwardly and upwardly within said cavity, said set of screws abutting said tapered sides of the upper portion of said shank.

15. Floating punch-holder according to claim 14, wherein an opening portion of said cavity has cross-section corresponding to the cross-section of the upper portion of said shank, and wherein positioning of said shank within said cavity is provided by means of preliminary axial rotating of said shank within said cavity at 45° which facilitates proper positioning of sides of said upper portion against corresponding screws of said set of screws and retaining of said shank in place during positioning.

* * * * *